US005448211A

United States Patent [19]

Mariani

[11] Patent Number: 5,448,211

[45] Date of Patent: Sep. 5, 1995

[54] PLANAR MAGNETICALLY-TUNABLE BAND-REJECTION FILTER

[75] Inventor: Elio A. Mariani, Hamilton Square, N.J.

[73] Assignee: The United States of America as represented by the Secretary of the Army, Washington, D.C.

[21] Appl. No.: 308,111

[22] Filed: Sep. 14, 1994

[51] Int. Cl.[6] ..... H01P 1/20

[52] U.S. Cl. ..... 333/205; 333/219.2

[58] Field of Search ..... 333/175, 202, 205, 219.2

[56] References Cited

U.S. PATENT DOCUMENTS 4,620,169 10/1986 Blickstein ..... 333/205 X 5,309,127 5/1994 Mariani ..... 333/205 X

*Primary Examiner*—Paul Gensler

*Attorney, Agent, or Firm*—Michael Zelenka; James A. DiGiorgio

[57] ABSTRACT

A planar, magnetically-tunable, band-rejection filter comprising a slot-line having at least one magnetically tunable, dielectric resonator-stack positioned on its top surface. The core of each resonator stack is filled with ferrite material. As a result, the filter provides a higher "Q", and thus provides greater suppression of unwanted microwave and millimeter-wave signals than the prior art.

1 Claim, 2 Drawing Sheets

PLANAR MAGNETICALLY-TUNABLE BAND-REJECTION FILTER

GOVERNMENT INTEREST

The invention described herein may be manufactured, used, and licensed by or for the Government for governmental purposes without the payment to me of any royalties thereon.

FIELD OF INVENTION

The invention relates to microwave filters, and more specifically to a magnetically-tunable planar narrow-band-rejection filter for signals in the microwave to millimeter-wave frequency range.

BACKGROUND OF THE INVENTION

Bandpass and band-rejection filters have been widely used to control the flow of signals that propagate in electronic circuits. A bandpass filter is an electrical filter that allows a band of frequencies comprising a signal to pass through the circuit with minimal loss. A band-rejection filter, however, is an electrical filter that rejects or suppresses a band of frequencies.

In microwave and millimeter-wave receiver systems, undesired signals can often appear in the frequency band of interest. As a result, these unwanted signals can create interference problems within the receiver or they can saturate the amplifier of the receiver and "choke-off" the desired signals from the receiver system. To reduce the effect of these unwanted signals, those skilled in the art have incorporated tunable RF notch filters into the front-end of the receiver system. These notch filters essentially reject or suppress a narrowband of frequencies within the band of frequencies for which the receiver operates. Typically, such notch filters can be tuned to reject a narrow band or rejection band within the band of frequencies for which the receiver operates.

One such type of notch filter, a yttrium-iron-garnet (hereinafter YIG) filter is comprised of a plurality of magnetically tunable YIG spheres which basically act like tuned circuits. These YIG spheres, however, are non-planar bulky devices, and thus are not desirable for systems using integrated circuits.

A type of microwave band-rejection filter that is more useful in such planar applications is a tunable band-rejection slot-line filter. A band-rejection slot-line filter is basically composed of a plurality of slot-line resonators etched in the ground plane of a microstrip. The term "slot-line resonator" refers to the slots etched in the metallic ground plane formed on the dielectric substrate which separates a microstrip from an opposing ground plane. These slot-line resonators, when fabricated on a ferrite substrate, can be tuned to suppress or stop a narrow-band of frequencies within a frequency band by applying a variable magnetic bias to the ferrite substrate. The efficiency of the frequency suppression of such a slot-line resonator is directly dependant on the "Q" of the slot-line structure.

Heretofore, however, such planar tunable slot-line resonators have a relatively low "Q". It has been determined that slot-line filters of the type described above have a "Q" on the order of less than 100, and thus can only provide about 20 db of suppression of the unwanted signal per slot-line. As a result, for a given bandwidth, prior art slot-line resonators have a limited ability to suppress unwanted signals.

SUMMARY OF THE INVENTION

Accordingly, the present invention provides a tunable planar band-rejection circuit that has a higher "Q", and thus provides greater suppression of unwanted microwave and millimeter-wave signals, than the prior art. To attain this, the present invention provides a planar circuit composed of a dielectric substrate containing a slot-line on one surface and at least one ferrite-loaded, magnetically-tunable, dielectric resonator positioned on the slot-line such that a predetermined narrowband of frequencies can be suppressed more efficiently than the prior art.

In a preferred embodiment, two stacks of ferrite-loaded, dielectric resonators are coupled to a dielectric slot, that essentially forms a slot-line, which is magnetically coupled to two microstrip transmission lines in a microwave or millimeter wave circuit. The stacks of ferrite loaded dielectric resonators are coupled to the slot-line through low dielectric constant, low-loss dielectric spacers which control the coupling strength between the resonator stack and the slotline. Moreover, the dielectric resonators within a stack are coupled to each other through low dielectric constant, low-loss dielectric spacers. The position of the dielectric resonator relative to the center line of the slot transmission line controls the coupling.

This configuration significantly increases the band-rejection capability of the resonator. It has been observed that the higher the "Q" of the resonator structure, the greater the suppression of the unwanted frequencies. Moreover, as the resonators in a stack increase in number, the rejection level increases as well. Consequently, the present invention overcomes, to a large extent, the problems that have beset the preselectors of the prior art.

These and other features of the invention are described in more complete detail in the following description of the preferred embodiment when taken with the drawings. The scope of the invention, however, is limited only by the claims appended hereto.

DETAILED DESCRIPTION OF THE INVENTION

Figure 1A:
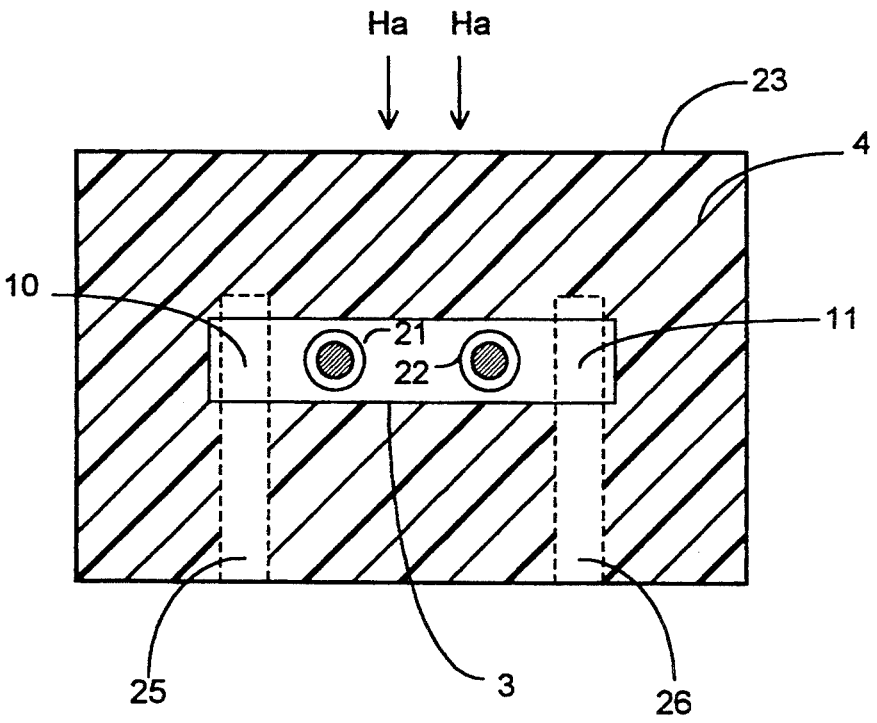
FIG. 1*a* is a top view of a preferred embodiment of the invention.
Figure 1B:
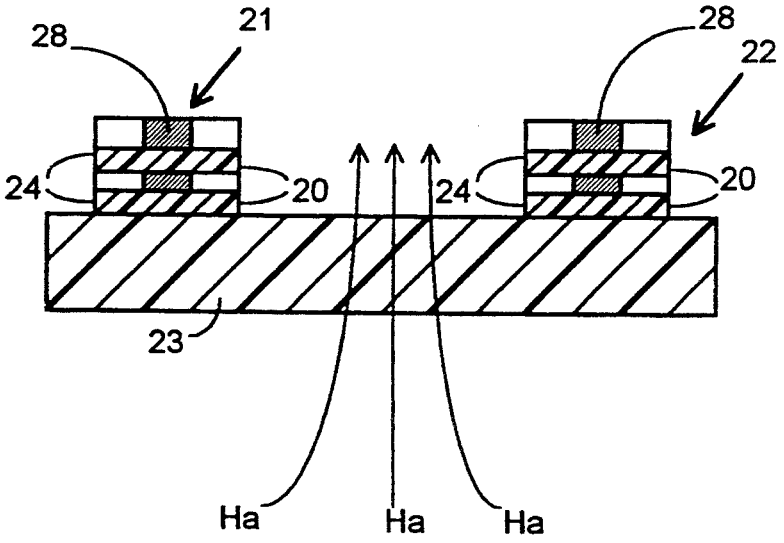
FIG. 1*b* is a side view of the preferred embodiment shown in FIG 1*a*.

Referring now to FIGS. 1*a* and 1*b* there is shown a preferred embodiment of the invention. As shown, a slot line 3 is formed in a ground plane 4 on a dielectric slab 23. Slot line 3 is magnetically coupled to input microstrip line 25 and output microstrip line 26 through microstrip-slotline transition points 10 and 11, respectively.

Figure 2:
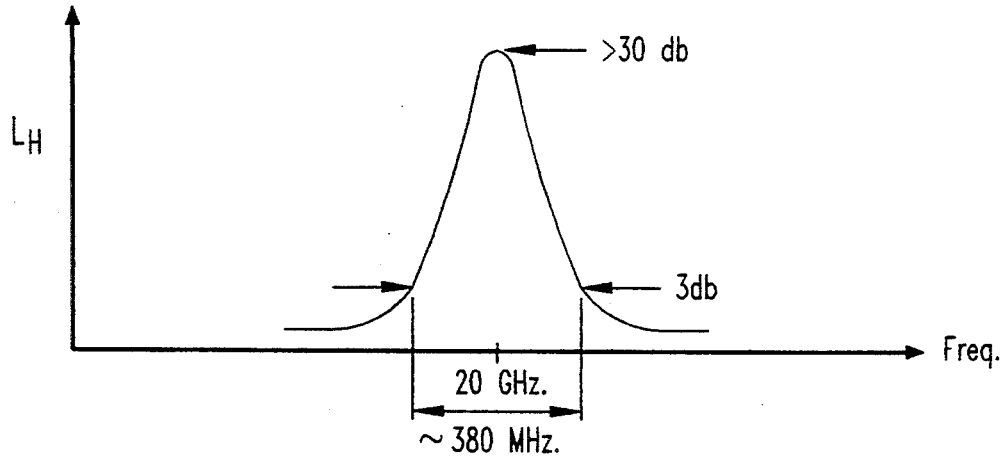
FIG. 2 is a graph of the insertion loss of a preferred embodiment when the band-rejection filters are tuned to the same center frequency.
Figure 3:
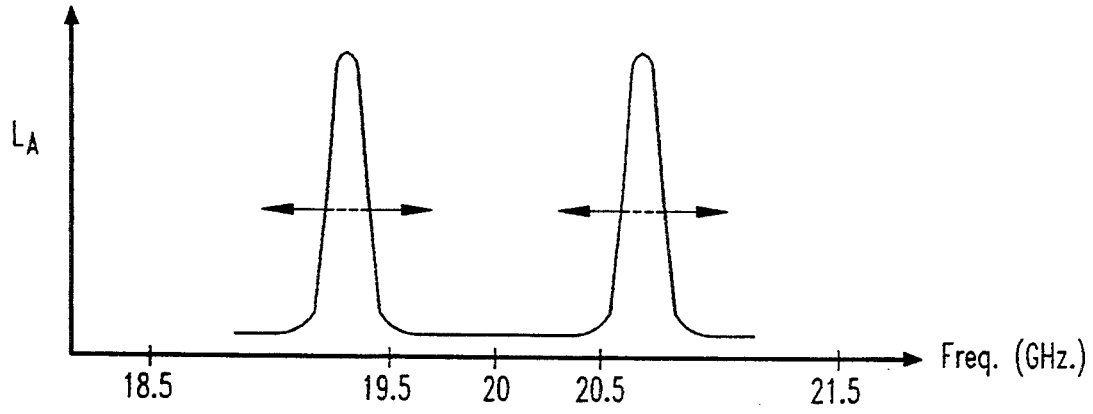
FIG. 3 is a graph of the insertion loss of a preferred embodiment when the band-rejection filters are tuned to two different center frequencies.

Ferrite loaded dielectric resonator stacks or band-rejection filters 21 and 22 are coupled to the top surface of slot-line 3 through dielectric spacers 20. Band-rejection filters 21 and 22 are composed of a plurality of dielectric resonators 24 that are also coupled to each other through dielectric spacers 20. Each dielectric resonator 24 is loaded with a core of ferrite material 28. The ferrite core 28 passes through dielectric resonators 24 and spacers 20. By applying a magnetic field to the ferrite core 28, each band-rejection filter 21 and 22 can be tuned to reject or suppress a predetermined narrow stop band of frequencies within a frequency range of the input signal. As a result, depending on the magnetic bias, band-rejection filters 21 and 22 can operate independently, and thus reject the same or a different frequency band. This is illustrated in FIGS. 2 and 3 which show the insertion loss of two different structures when their ferrite resonators are tuned to the same (FIG. 2) and different (FIG. 3) center frequencies.

In operation, a microwave or millimeter-wave signal travelling from input microstrip 25 creates a magnetic field that couples the signal to slot line 3 through microstrip-slotline transition 10. The signal then passes through band-rejection filters 21 and 22, and magnetically couples to output microstrip 26 through microstrip-slotline transition 11. Thus, output microstrip 26 passes an electrical current having all frequencies of the original signal except those suppressed by band-rejection filters 21 and 22.

As discussed above, dielectric band-rejection filters 21 and 22 can be tuned to remove a predetermined narrowband of frequencies from an input signal. These narrow stop bands have a center frequency that can be magnetically tuned by changing the magnetic bias field applied to the ferrite core of their respective band-rejection filters 21 and 22. FIG. 2 shows the insertion loss of the stop band when the ferrite-loaded resonators of both band-rejection filters 21 and 22 are tuned to 20 Ghz. FIG. 3 shows the insertion loss when the ferrite loaded resonators of filter 21 is tuned to a different center frequency from that of the ferrite loaded resonators comprising filter 22. As shown, at least 25 db of suppression can be achieved in the stop band, when the ferrite-loaded resonator has a composite Q=1150. Consequently, the present invention overcomes to a large extent the problems and limitations that have beset the prior art.

What is claimed is:

1. A planar magnetically-tunable band-rejection circuit, comprising:

a slot-line comprising a dielectric substrate having a top and a bottom surface, said bottom surface of said substrate resting on and magnetically coupled to an input and an output microstrip;

at least one dielectric band-rejection filter positioned on said top surface of said slot-line substantially between said input and output microstrips, each said dielectric band-rejection filter comprising a plurality of ferrite-loaded dielectric resonators stacked upon and coupled to each other through dielectric spacers, each said dielectric band-rejection filter coupled to said slot-line through a dielectric spacer, said dielectric resonators tuned by a magnetic field to a predetermined frequency such that each dielectric filter suppresses a predetermined narrowband within an input signal from said input microstrip.

* * * * *